US005857808A

United States Patent [19]

de Baan

[11] Patent Number: 5,857,808

[45] Date of Patent: Jan. 12, 1999

[54] LIMITED ROTATION RISER CONNECTION SYSTEM

[76] Inventor: Jaap de Baan, Kam. Onnesdreef 8, 3146 BH Maasslius, Netherlands

[21] Appl. No.: 922,031

[22] Filed: Sep. 2, 1997

[51] Int. Cl.[6] ..... E02D 5/74; B63B 21/52

[52] U.S. Cl. ..... 405/224; 405/195.1; 166/359; 114/230; 441/5

[58] Field of Search ..... 405/195.1, 224, 405/224.1, 224.2, 224.3, 224.4, 223.1, 223.2, 223.3, 223.4; 166/359, 355, 365, 367; 114/230, 293; 441/5

[56] References Cited

U.S. PATENT DOCUMENTS

| | | | |
|---|---|---|---|
| 3,074,082 | 1/1963 | Griebe | 441/5 |
| 3,354,479 | 11/1967 | Koppenol et al. | 441/5 |
| 3,922,992 | 12/1975 | Wilbourn | 114/230 |
| 4,176,615 | 12/1979 | Reid et al. | 114/230 |
| 4,271,865 | 6/1981 | Galloway et al. | 137/614.06 |
| 4,490,121 | 12/1984 | Coppens et al. | 114/230 X |
| 5,025,742 | 6/1991 | Urdshals | 114/230 |
| 5,178,087 | 1/1993 | O'nion et al. | 114/230 |
| 5,288,253 | 2/1994 | Undshals et al. | 114/230 X |
| 5,336,020 | 8/1994 | Askestad | 405/224 |
| 5,492,147 | 2/1996 | Chanllender et al. | 137/614.05 |
| 5,584,607 | 12/1996 | De Baan | 405/224 |

*Primary Examiner*—Tamara L. Graysay
*Assistant Examiner*—Jong-Suk Lee
*Attorney, Agent, or Firm*—Alan R. Thiele; Jenkens & Gilchrist

[57] ABSTRACT

The connection between a surface terminus for subsea production risers and a surface collection vessel is facilitated by a connection which utilizes slack loop flexible jumper hoses between the surface terminus of the subsea risers and a swivel coupling located on the surface vessel.

3 Claims, 4 Drawing Sheets

LIMITED ROTATION RISER CONNECTION SYSTEM

FIELD

The present invention pertains to production systems for use with subsea wells; more particularly the present invention pertains to systems in which risers from subsea wells are connected to a surface vessel.

BACKGROUND

The transfer of hydrocarbons from subsea wells to a collection point on the sea surface has been accomplished in a variety of different ways. For large deposits of hydrocarbons expensive subsea towers or floating platforms have been used. For smaller deposits whose production does not justify the expense of a subsea tower or floating platform, a surface collection vessel has been used. The surface collection vessel is specially moored to remain at a relatively constant location over the subsea wells. However because of waves, currents and wind, the surface collection vessel will rotate or weathervane around the surface terminus of the production risers. With such rotating or weathervaning motion of the surface collection vessel, it is often difficult to install a reliable system which can accommodate the rotation of the surface collection vessel and still maintain a fluid flow connection with the production risers extending from the subsea wells to the sea surface.

Various complex systems have been proposed to maintain fluid flow connections between a weathervaning vessel and the surface terminus of production risers. Such systems are described in U.K. Patent 2,270,132 and in U.S. Pat. Nos. 4,915,416 and 5,113,778; however, because of the reliability and complexity of those prior art systems, none of these systems has been widely adopted by the industry.

There remains, therefore, a need in the art to provide a simple, reliable system which will allow rotation or weathervaning of the surface collection vessel with respect to the surface terminus of production risers. Such system should not put undue stress on the production risers or create the possibility of leakage of the hydrocarbons as they flow from the production riser into temporary storage on board the surface collection vessel.

SUMMARY OF THE INVENTION

A simple, reliable system which both provides for rotation or weathervaning of a surface collection vessel with respect to the surface terminus of production risers from subsea wells is provided by the limited rotation riser connection system of the present invention.

The disclosed limited rotation riser connection system includes a substantially stationary moored turret assembly. The substantially stationary moored turret assembly provides a terminus just above the sea surface for the production risers which carry hydrocarbons upward from subsea wells. Providing a flow path from the substantially stationary moored turret assembly to the tanks on board the surface collection vessel are slack loop flexible jumper hoses. The slack loop flexible jumper hoses include provisions for connection at a first or downstream end to the piping on the surface collection vessel, and at a second or upstream end to the substantially stationary turret assembly. The second end of the subsea risers is positioned by a turntable which surrounds the substantially stationary moored turret assembly. To minimize the torque on the slack loop flexible jumper hoses, the downstream end of the slack loop jumper hoses, which is connected to the surface collection vessel, further includes an in-line swivel coupling. The connection between the upstream end of the slack loop flexible jumper hose and the surface terminus for the production risers is a dry break coupling. Thus, when the upstream end of the slack loop flexible jumper hoses are connected to the surface terminus for the production risers, the turntable is effectively motionless and all of the rotating or weathervaning motion of the surface collection vessel about the substantially stationary moored turret assembly is absorbed by the large slack loop formed in the slack loop flexible jumper hoses. As the downstream end of the slack loop flexible jumper hoses connected to the surface collection vessel includes an in-line swivel coupling, twisting or torsion stress on the slack loop flexible jumper hose is minimized.

BRIEF DESCRIPTION OF THE FIGURES

A better understanding of the Limited Rotation Riser Connection System of the present invention may be had by reference to the drawings wherein.

DESCRIPTION OF THE EMBODIMENTS

Figure 1:
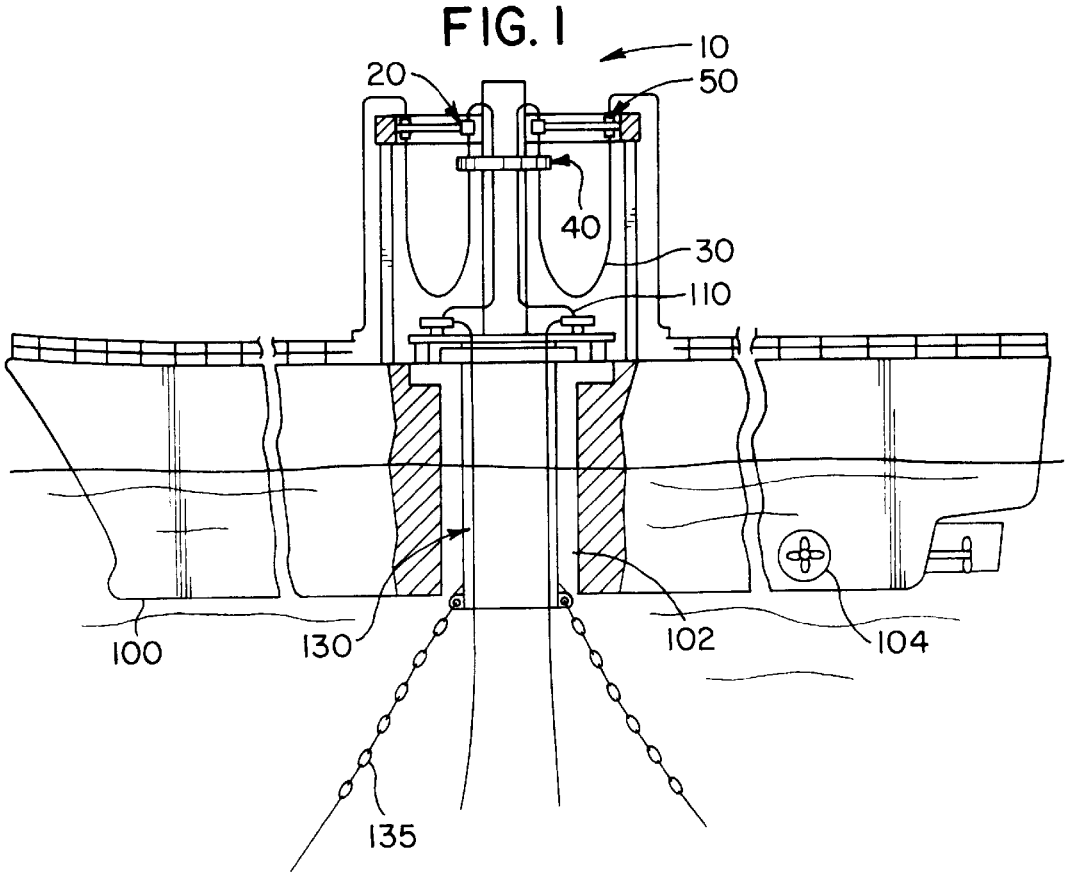
FIG. 1 is an elevational view, in partial section, of the limited rotation riser connection system of the present invention.
Figure 2:
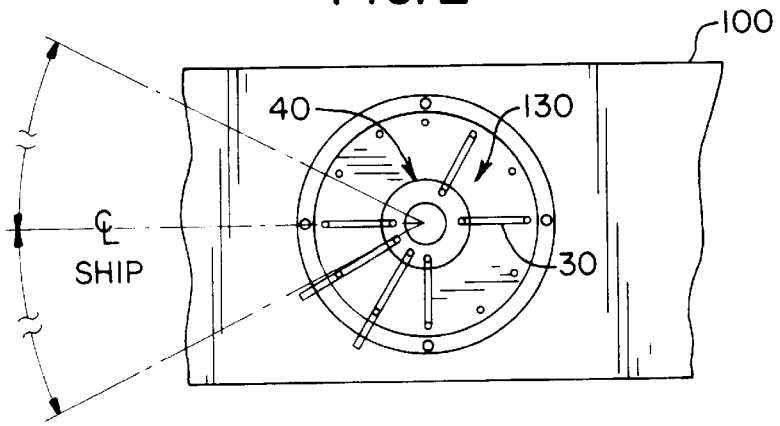
FIG. 2 is a top plan view of the system shown in FIG. 1.

A better understanding of the implementation of the limited rotation riser connection system 10 of the present invention may be had by reference to FIGS. 1 and 2. Therein it may be seen that the present invention is utilized with a ship or surface collection vessel 100 which includes an opening 102 for a moored 135 turret assembly 130. Typically, the heading of the ship 100 is controlled by thruster package 104 located in the aft section of the hull. Generally, such heading is into the weather to limit vessel roll motions.

The moored 135 turret assembly 130 provides a sea surface terminus for the subsea production risers 110. The hydrocarbons from subsea wells pass upwardly through the subsea production risers 110 and are piped into storage tanks (not shown) on the ship 100 for temporary storage. Typically, other hydrocarbon transport ships are positioned near the surface collection vessel 100 to unload the hydrocabons from the surface collection vessel 100 which is permanently moored above the subsea wells.

Figure 5:
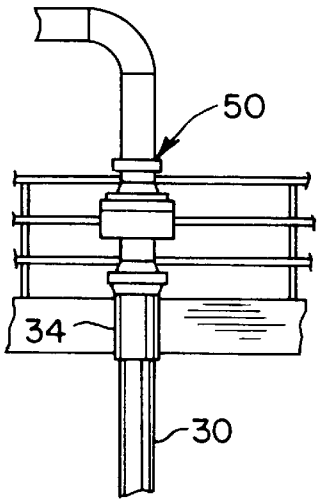
FIG. 5 is an expanded view of that portion of FIG. 3 showing the swivel connection between the slack loop flexible jumper hose and the surface collection vessel.
Figure 4:
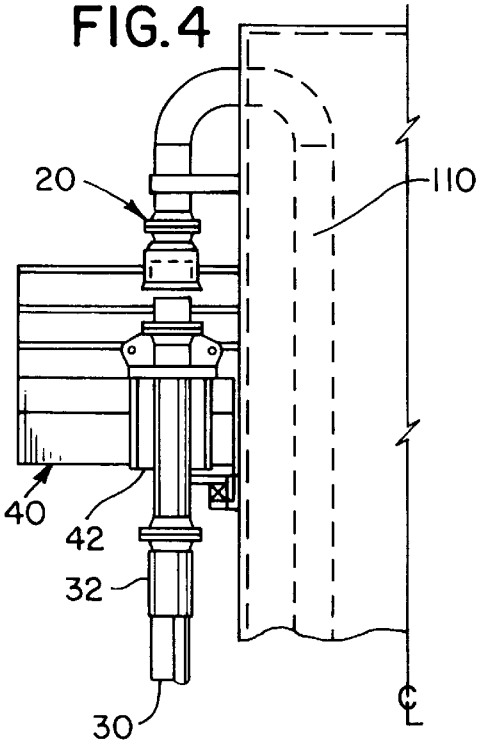
FIG. 4 is an expanded view of that portion of FIG. 3 showing an open, dry break connection between the surface terminus of the production riser and the slack loop flexible jump hose.
Figure 3:
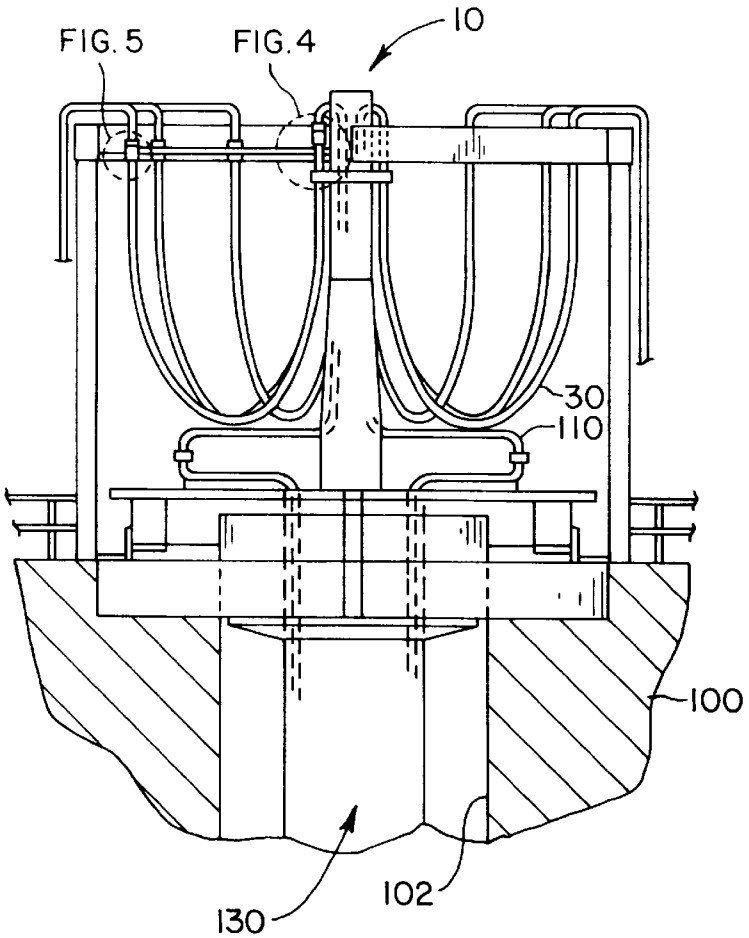
FIG. 3 is an expanded view of that portion of FIG. 1 showing the connections to the slack loop flexible jumper hoses.
Figure 6:
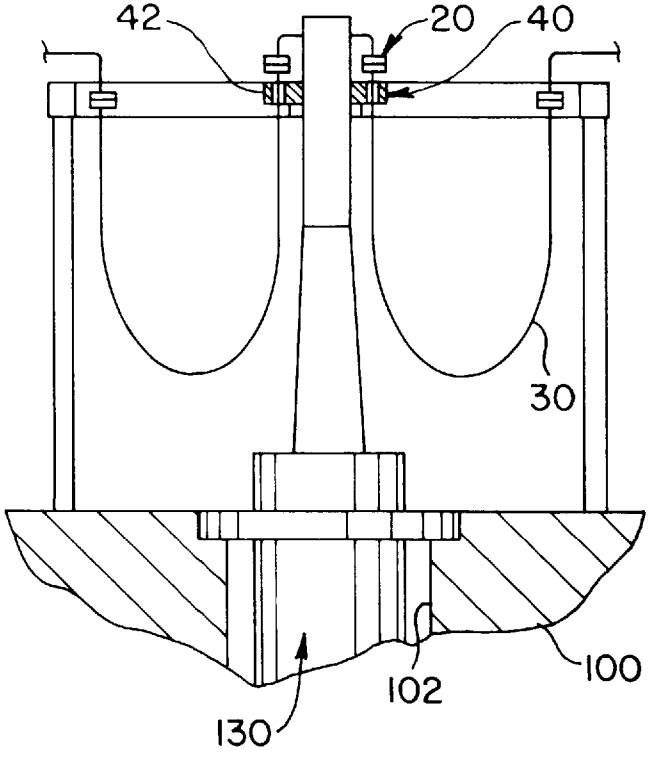
FIG. 6 is a schematic view similar to that shown in FIG. 3 in the operating mode.

In FIG. 3 it may be seen that the moored 135 turret assembly 130 passes through an opening 102 in the ship 100. The production risers 110 have a surface terminus connection assembly 20 (FIG. 4) at the top of the turret assembly 130. This surface terminus connection assembly 20 is a dry break coupling assembly. It is important that this dry break coupling assembly 20 of the surface terminus of the production risers 110 be very easy to disconnect and reconnected. The slack loop flexible jumper hoses 30 pass through an hole 42 in a turntable assembly 40 to a swivel connection assembly 50 which is located on board the surface vessel 100. Thus when the dry break coupling assemblies 20 are made up and hydrocarbons are passing through the subsea production risers 110 into the ship 100 as shown in FIG. 6, the turntable assembly 40 is effectively stationary, being held in position by the slack loop flexible jumper hoses 30 which, in turn, are held in position by the made-up dry break connection assemblies 20 between the surface terminus of the production risers 110 and the upstream end of the slack loop flexible jumper hoses 30. The downstream end 34 of the slack loop flexible jumper hoses 30 is connected by a swivel connection assembly 50 (FIG. 5) to ship board piping.

Figure 7:
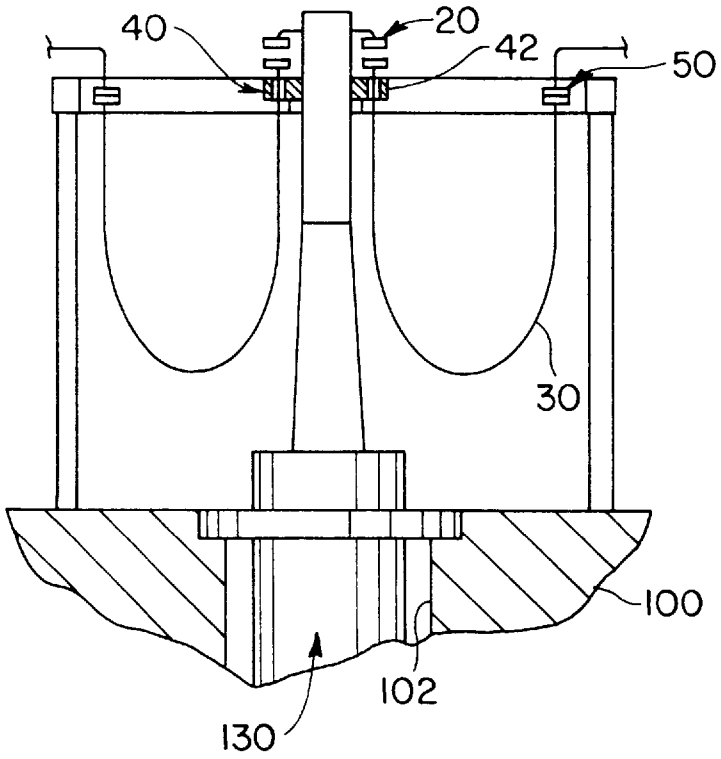
FIG. 7 is a schematic view similar to that shown in FIG. 6 in the disconnect mode.

As may be seen in FIG. 7, when the dry break connection assemblies 20 are disconnected, the turntable assembly 40 is free to rotate about the turret assembly 130. As there will be a number of different dry break connection assemblies 20 for the production risers 110, the ship 100 is free to rotate with respect to the turret assembly 130 until such time as a connection needs to be made to create a flow path for the hydrocarbons from the production risers 110, through the slack loop flexible jumper hoses 30 through shipboard piping and into the storage tanks on board the ship 100. Before the time for a need to create a flow path occurs, the turntable assembly 40 which holds the upstream end 32 of the slack loop flexible jumper hoses 30 is allowed to rotate with respect to the turret assembly 130. When the time comes for making up a flow connection, the flow connection is made between the upstream end 32 of the slack loop flexible jumper hoses 30 and the surface terminus of the production risers 110. This creates the flow condition shown in FIG. 6.

Figure 8:
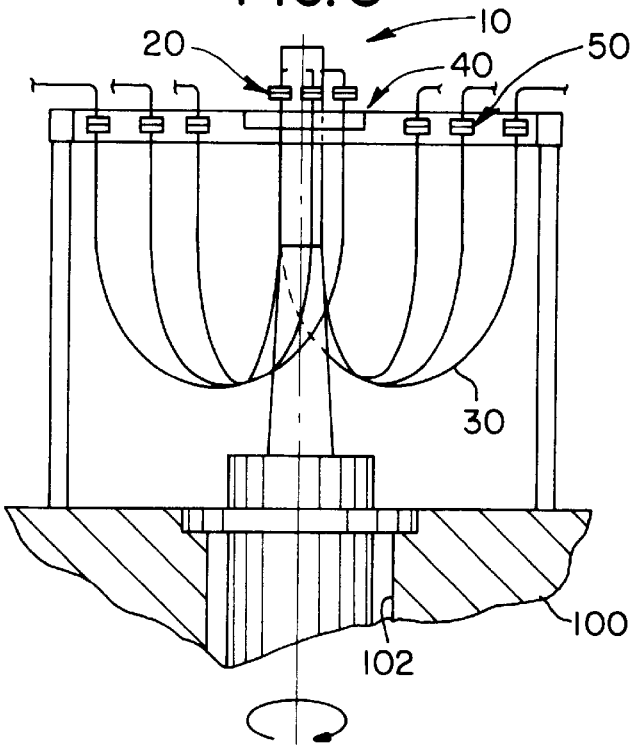
FIG. 8 is a schematic view similar to that shown in FIG. 6 where the slack loop flexible jumper hoses have absorbed the rotation or weathervaning of the surface collection vessel.

As the ship 100 rotates around the substantially stationary moored 135 turret assembly 130, the slack loop flexible jumper hoses 30 will wrap around the moored 135 turret assembly 130 as may be seen in FIG. 8. Thus, the rotating motion between the ship 10 and the moored 135 turret assembly is taken up by the removal of the slack from a loop formed in the slack loop flexible jumper hoses 30 as they rotate around the upper portion of the turret assembly 130. Torsional loads in the slack loop flexible jumper hoses 30 is eliminated by the swivel joint assembly 50 on their downstream end 34. The only limitation on the amount of ship 100 rotation about the moored 135 turret assembly 130 is the flexibility and the length of the slack loop flexible jumper hose 30.

Figure 9:
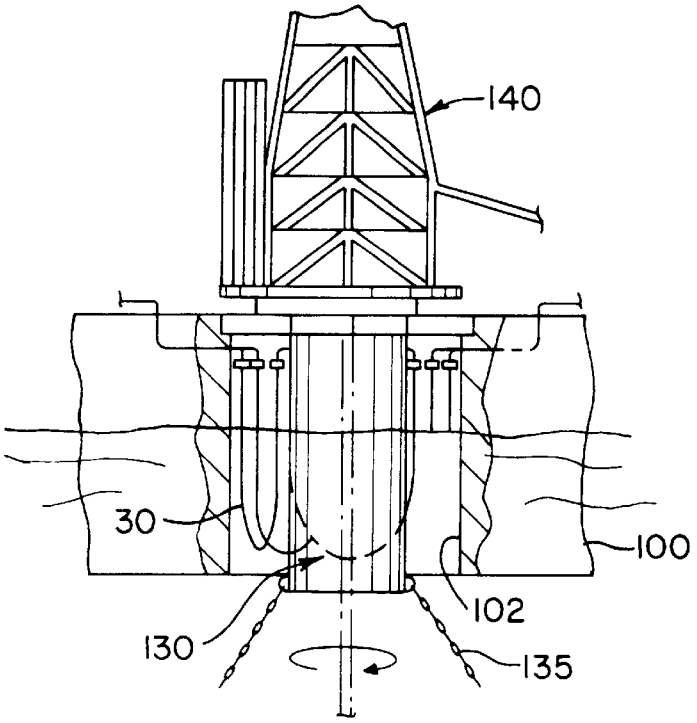
FIG. 9 is an elevational view in partial section of the limited rotation riser system used in combination with a drilling rig working through the center of the moored turret assembly.

It is also possible to utilize the system 10 of the present invention with a ship 100 mounted drill tower 140. Such construction is shown in FIG. 9. Therein it may be seen that the turret assembly 130 which passes through an opening 102 in the ship 100 moves with respect to the ship 100. As previously, the rotation or weathervaning of the ship 100 with respect to the turret assembly 130 takes up the slack in the slack loop flexible jumper hoses 30, as shown in FIG. 8.

There is thereby provided by the present invention a system which will not put undue stress on production risers or create the possibility of leakage as hydrocarbons flow from subsea wells to a surface collection vessel.

While the present invention has been explained by reference to the disclosed preferred embodiment; those of ordinary skill in the art will appreciate that other embodiments of the limited rotation riser connection system are possible by using the principles incorporated in the embodiment described herein. Such other embodiments shall be included in the scope and meaning of the appended claims.

I claim:

1. A system for connecting the surface terminus of production risers from subsea wells to a surface collection vessel, said system comprising:

a substantially stationary moored turret assembly, said substantially stationary moored turret assembly containing the surface terminus of the production risers;

at least one slack loop flexible jumper hose, said at least one slack loop flexible jumper hose constructed and arranged to be connectable at a first or downstream end to the surface collection vessel by a swivel coupling assembly and connectable at a second or upstream end to the surface terminus of the production risers so that when the surface collection vessel rotates with respect to said substantially stationary moored turret assembly, said at least one slack loop flexible jumper hose wraps around said substantially stationary moored turret assembly;

rotatable means for positioning said second or upstream end of said at least one slack loop flexible jumper hose near said substantially stationary moored turret assembly.

2. The system as defined in claim 1, wherein the connection between said second or upstream end of said at least one slack loop flexible jumper hose and said surface terminus for the production risers is a dry break coupling.

3. The system as defined in claim 1 wherein said rotatable means for positioning said second or upstream end of said at least one slack loop flexible jumper hose near said substantially stationary turret assembly is a turntable assembly constructed and arranged to surround said substantially stationary moored turret assembly.

* * * * *